US005213430A

United States Patent [19]

Pandola

[11] Patent Number: 5,213,430

[45] Date of Patent: May 25, 1993

[54] COMBINATION SHOE BRUSH AND LIQUID APPLICATOR

[76] Inventor: Thomas A. Pandola, 23055 Sherman Way, West Hills, Calif. 91307

[21] Appl. No.: 826,129

[22] Filed: Jan. 27, 1992

[51] Int. Cl.[5] ..... A46B 11/02

[52] U.S. Cl. ..... 401/137; 401/39; 401/139

[58] Field of Search ..... 401/137, 139, 39

[56] References Cited

U.S. PATENT DOCUMENTS

| | | | |
|---|---|---|---|
| 873,550 | 10/1907 | Hudson | 401/39 |
| 2,490,440 | 12/1949 | Jacobs | 401/137 X |
| 2,972,768 | 2/1961 | Petion | 401/139 X |
| 3,135,990 | 6/1964 | Bergmann et al. | 401/139 X |
| 4,778,301 | 10/1988 | Sicotte | 401/137 X |

FOREIGN PATENT DOCUMENTS

| | | | |
|---|---|---|---|
| 524417 | 5/1956 | Canada | 401/39 |
| 1503751 | 4/1969 | Fed. Rep. of Germany | 401/137 |
| 2472927 | 7/1981 | France | 401/139 |

*Primary Examiner*—Steven A. Bratlie

[57] ABSTRACT

A combined shoe brush and liquid container that has an atomizer head attached. The shoe brush has a conforming opening on one end to allow the engagement of a like conforming liquid container. The container is held in place with two spring devices which allow the container to be manually inserted into opening, and reversely allows the container to be manually extracted to facilitate refilling or replacing the container with a new like container. One end of the shoe brush has a cut away area which allows only the atomizer head to protrude outside of the shoe brush base. This allows the user to operate the atomizer in a push down manner with a convenient finger. The container holds for application, water or shoe polishing liquid to be sprayed through atomizer onto shoe surface, then brushed to produce a shine.

1 Claim, 1 Drawing Sheet

COMBINATION SHOE BRUSH AND LIQUID APPLICATOR

BACKGROUND OF THE INVENTION

This invention relates to a shoe brush, and more particularly to a shoe brush having one part serving as a conventional shoe brush, and one part serving as a liquid spray applicator.

In polishing shoes, it is general procedure to apply polish, brush out a shine, and apply water to brush out a high gloss shine.

Accordingly, it has been practice to apply the water by sprinkling the shoes with water from a container separate from the brush. In addition, it is a general practice to use ones saliva instead of water, thereby producing what is commonly known as a "spit shine". This said procedure is not only inconvenient, it is awkward and generally an unsanitary practice in the instance of introducing ones saliva instead of water for convenience, especially in areas where a community shoe brush is utilized, i.e. fire and police departments, military installations, etc.

There have been various suggestions in prior art for combining a shoe brush with a dauber or polish applicator, however, no prior art is found combining a shoe brush and a liquid spray applicator.

As such, it may be appreciated that there is a continuing need for a new and improved device to allow for convenient and sanitary application of water to produce a high gloss shine to shoes by combining a liquid container and atomizer head with a conventional shoe brush, the present invention substantially fulfills this need.

SUMMARY OF THE INVENTION

Accordingly, it is an object of the present invention to provide an improved shoe brush which avoids the aforementioned problems associated with producing a shine on shoes.

Yet another object of the present invention is to provide a combined shoe brush and liquid container with atomizer head to avoid the aforementioned problems associated with shoe polishing.

Still another object of the present invention is to provide a combined shoe brush and liquid container with atomizer head which can be readily fit together, and readily taken apart to facilitate either refilling the container, or by inserting a replacement container.

Another object of the present invention is to provide a spring device that allows the liquid container to slide into the conforming opening and be secured in place, while also allowing the easy removal of same.

My invention resides not in any one of these features per se, but rather in the particular combination of all of them herein disclosed and claimed and it is distinguished from any prior art in this particular combination of all its structures for the function specified.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Briefly, in accordance with the present invention, there is provided a combined shoe brush and liquid container with atomizer head. The liquid container engages into a conforming opening in one extreme end of said shoe brush. The shoe brush also has a cut away area, left open by design to facilitate the user to operate the atomizer head with a convenient finger, while not allowing the atomizer head to protrude beyond the end of the shoe brush base or structure.

The contents of the container is applied to the surface of the shoe using the atomizer, followed by the act of brushing the shoe surface to produce a shine. The liquid container is held in place by two springs which deflect inward, allowing the container to pass into the brush opening and, with moderate force, will yield and deflect in order to extract said container. Said container is specifically molded with two notches that align with the two springs fitted in the brush opening. When the container is properly seated in the brush opening, the springs rest inside said notches, thereby securing container in place.

The aforementioned objects, features and advantages of the present invention will, in part, be pointed out with particularity, and will , in part become obvious from the following more detailed description of the invention, taken in conjunction with the accompanying drawing, which forms an integral part thereof.

DESCRIPTION OF THE PREFERRED EMBODIMENT

Figure 1:
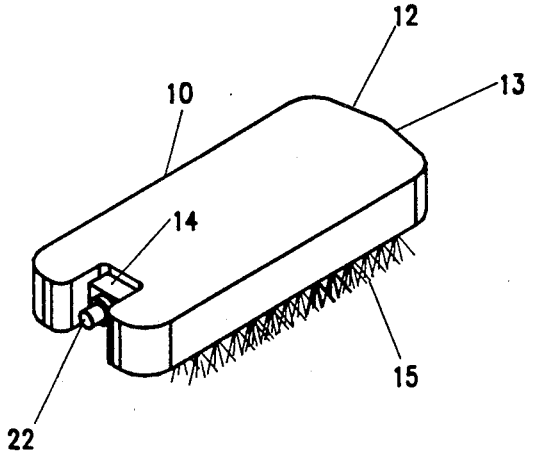
FIG. 1 is a perspective view showing the combined shoe brush and liquid container with atomizer head in an assembled for use condition according to the present invention.
Figure 2:
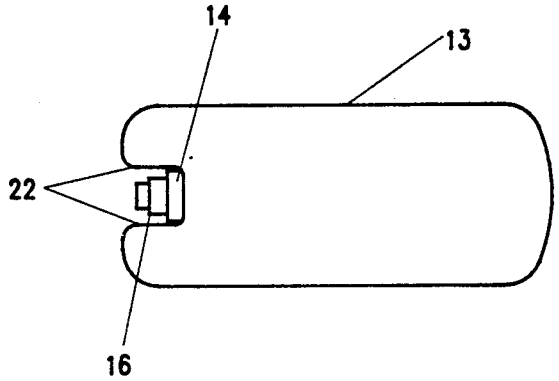
FIG. 2 is a plain section view showing the extreme end of the shoe brush with the cut away area and the atomizer head as viewed from the top.
Figure 3:
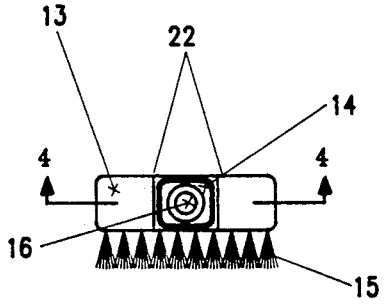
FIG. 3 is an elevational view of the extreme end of the brush, showing the top of the liquid container and atomizer head in place.
Figure 5:
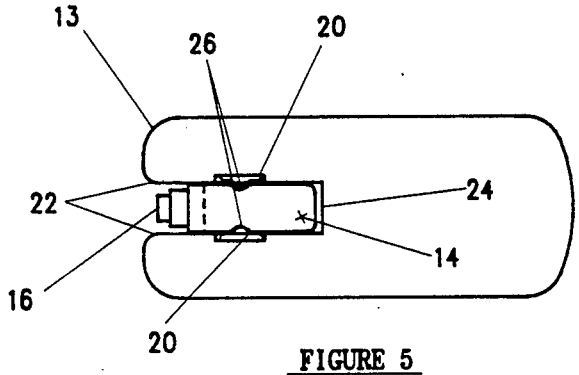
FIG. 5 is a detail view showing the location and shape of springs which deflect to allow the liquid container to pass into and out of said conforming opening, while securing the same during normal use.
Figure 6:
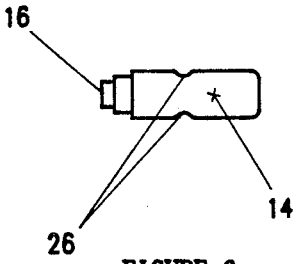

Referring now to the drawings, the present invention is directed to a combined shoe brush and liquid container with atomizer head which is shown generally at 10. The arrangement is formed of a shoe brush shown generally at 12, and a liquid container with atomizer head shown generally at 14. Said container 14, is secured in place and allowed to be removed by use of two spring devices 20 that deflect and secure or disengage conforming notches on two sides of 14.

The shoe brush section includes a base member 13, from which depend bristles 15. The liquid container 14, fits into a conforming opening in 13. The atomizer head 16 is removeable in a common screw thread manner from the liquid container 14.

A cut away area 22 is located at the end of the brush where the atomizer 16 extends out of brush base 13. This allows access to atomizer 16, with a convenient finger. This open area 22 also allows the contents of container 14 dispensed through atomizer 16 to be applied to shoe surface without being blocked or interrupted by bristlets 15.

Figure 4:
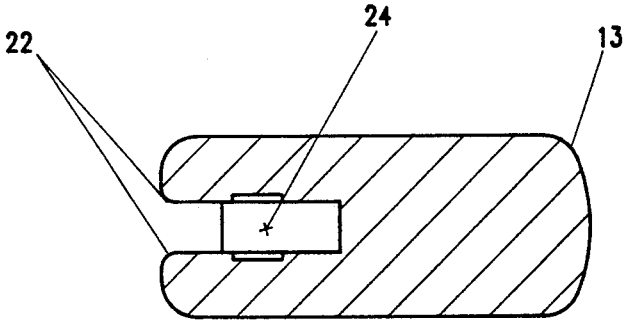
FIG. 4 is a plain exploded view showing the relationship of the brush with conforming opening and the liquid container, including the molded notches on the container's sides.

The removeable container 14 is held in place by two springs 20, which deflect to engage container 14, which has molded notches of equal or slightly greater size 26. The springs 20 are located in a cut out void which allows them to deflect as the container body 14 is moved past them, either inward or outward. With a moderate amount of outward force, said springs will deflect to allow container 14 to be disengaged as shown in FIG. 4.

It is understood in the utilization of the instant invention and upon applying contents of container 14 through atomizer 16 onto shoe surface, a convenience never before known will be appreciated, furthermore, a more sanitary method for obtaining a high gloss shine on shoes will be afforded the user, in that, it will no longer be necessary to apply ones saliva to achieve the desired resulting high gloss shoe shine.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed as being new and desired to be protected by Letters Patent of the U.S is as follows:

1. A combined shoe brush and liquid container arrangement comprising, a conventional shoe brush constructed with an opening on one end which accepts a conforming sized liquid container with an atomizer head attached, p1 and said shoe brush is constructed with a cut away section on one end working in conjunction with the opening stated above allowing the operation of the atomizer with a convenient finger and while not protruding beyond the end of the brush base allowing contents of container to be applied through the atomizer to shoe surface without being blocked or interrupted by brush bristles, and said liquid container is constructed to fit conforming opening in brush base and capable of manual insertion and extraction, wherein the liquid container is secured in place by two springs that are resilient and deflect to provide adequate clearance for the container body to pass into or out of conforming opening, said liquid container is constructed with two notches that align with the two springs securing container inside brush base opening when properly seated and ready for use while allowing the removal of container with moderate manual force.

* * * * *